US007713096B2

(12) United States Patent
Pavlovic et al.

(10) Patent No.: US 7,713,096 B2
(45) Date of Patent: May 11, 2010

(54) MODULAR ELECTRICAL CONNECTOR

(75) Inventors: Slobodan Pavlovic, Canton, MI (US); David Menzies, Linden, MI (US); Mohamad Zeidan, Dearborn Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/006,973

(22) Filed: Jan. 7, 2008

(65) Prior Publication Data

US 2009/0176412 A1 Jul. 9, 2009

(51) Int. Cl.
*H01R 13/502* (2006.01)

(52) U.S. Cl. ..... 439/701; 439/717

(58) Field of Classification Search ..... 439/83, 439/567, 701, 717
See application file for complete search history.

(56) References Cited

U.S. PATENT DOCUMENTS 4,425,018 A * 1/1984 Stenz ..... 439/716
5,951,306 A * 9/1999 Millhimes ..... 439/79
6,083,047 A 7/2000 Paagman
6,171,149 B1 1/2001 van Zanten
6,406,335 B2 * 6/2002 Sato et al. ..... 439/701
6,527,588 B2 3/2003 Paagman
6,540,566 B1 4/2003 Wu
6,609,929 B2 * 8/2003 Kamarauskas et al. ... 439/541.5
6,638,114 B2 * 10/2003 Lee ..... 439/701
6,808,420 B2 10/2004 Whiteman, Jr. et al.
6,881,100 B2 * 4/2005 Barry et al. ..... 439/701
6,945,828 B2 * 9/2005 Kamei et al. ..... 439/717
7,059,907 B2 6/2006 Winings et al.
7,074,086 B2 7/2006 Cohen et al.
7,182,643 B2 2/2007 Winings et al.
7,247,045 B1 * 7/2007 Arellano ..... 439/416
7,278,886 B2 10/2007 Cohen et al.
7,297,027 B2 11/2007 Liang
7,303,401 B2 12/2007 Schell et al.

* cited by examiner

*Primary Examiner*—Thanh-Tam T Le
(74) *Attorney, Agent, or Firm*—MacMillan, Sobanski & Todd, LLC

(57) ABSTRACT

A modular electrical connector including at least one body portion having an electrical terminal and at least one mating surface. An end portion has a mating surface interconnected to the mating surface of the body portion. The body portion and the end portion define a connector body.

14 Claims, 4 Drawing Sheets

MODULAR ELECTRICAL CONNECTOR

BACKGROUND

Various embodiments of an electrical connector are described herein. In particular, the embodiments described herein relate to an improved electrical connector for surface mount technology (SMT) applications.

As the use of electronic devices becomes increasingly prevalent, there is a need to provide an increasing number of electronic components on printed circuit boards (PCBs). It has not been uncommon for an electronic component to have wire leads that were inserted into holes in the PCB. With such "through-hole" technology, the wire leads from the electronic component extended completely through the PCB. This made it very difficult to use both sides of the PCB for different circuits.

In many applications, electrical connections on PCBs are being made with SMT. With SMT components, blade terminals are connected to a surface on one side of the PCB, usually by soldering. This leaves the opposite side of the PCB available for constructing a different circuit using the same or different SMT components. It would however, be desirable to provide an improved electrical connector for SMT applications.

SUMMARY

The present application describes various embodiments of an improved modular electrical connector. One embodiment of the modular electrical connector includes at least one body portion having an electrical terminal and at least one mating surface. An end portion has a mating surface interconnected to the mating surface of the body portion. The body portion and the end portion define a connector body.

In another embodiment, the modular electrical connector includes a first body portion having an electrical terminal and opposing mating surfaces. A second body portion has an electrical terminal and opposing mating surfaces. A mating surface of the first body portion is interconnected to a mating surface of the second body portion. An end portion has a mating surface interconnected to one of the mating surface of the first body portion and the mating surface of the second body portion. The first body portion, the second body portion, and the end portion define a connector body.

In another embodiment, the modular electrical connector includes a first body portion having an electrical terminal and opposing mating surfaces. One mating surface defines a male connector portion and the other mating surface defines a female connector portion. A second body portion has an electrical terminal and opposing mating surfaces. One mating surface defines a male connector portion and the other mating surface defines a female connector portion. A mating surface of the first body portion is interconnected to a mating surface of the second body portion. An end portion has a mating surface, wherein the mating surface is one of a male connector portion and a female connector portion. The mating surface of the end portion is interconnected to one of a mating surface of the first body portion and a mating surface of the second body portion. The first body portion, the second body portion, and the end portion define a connector body.

Other advantages of the electrical connector will become apparent to those skilled in the art from the following detailed description, when read in light of the accompanying drawings.

DETAILED DESCRIPTION

Figure 1:
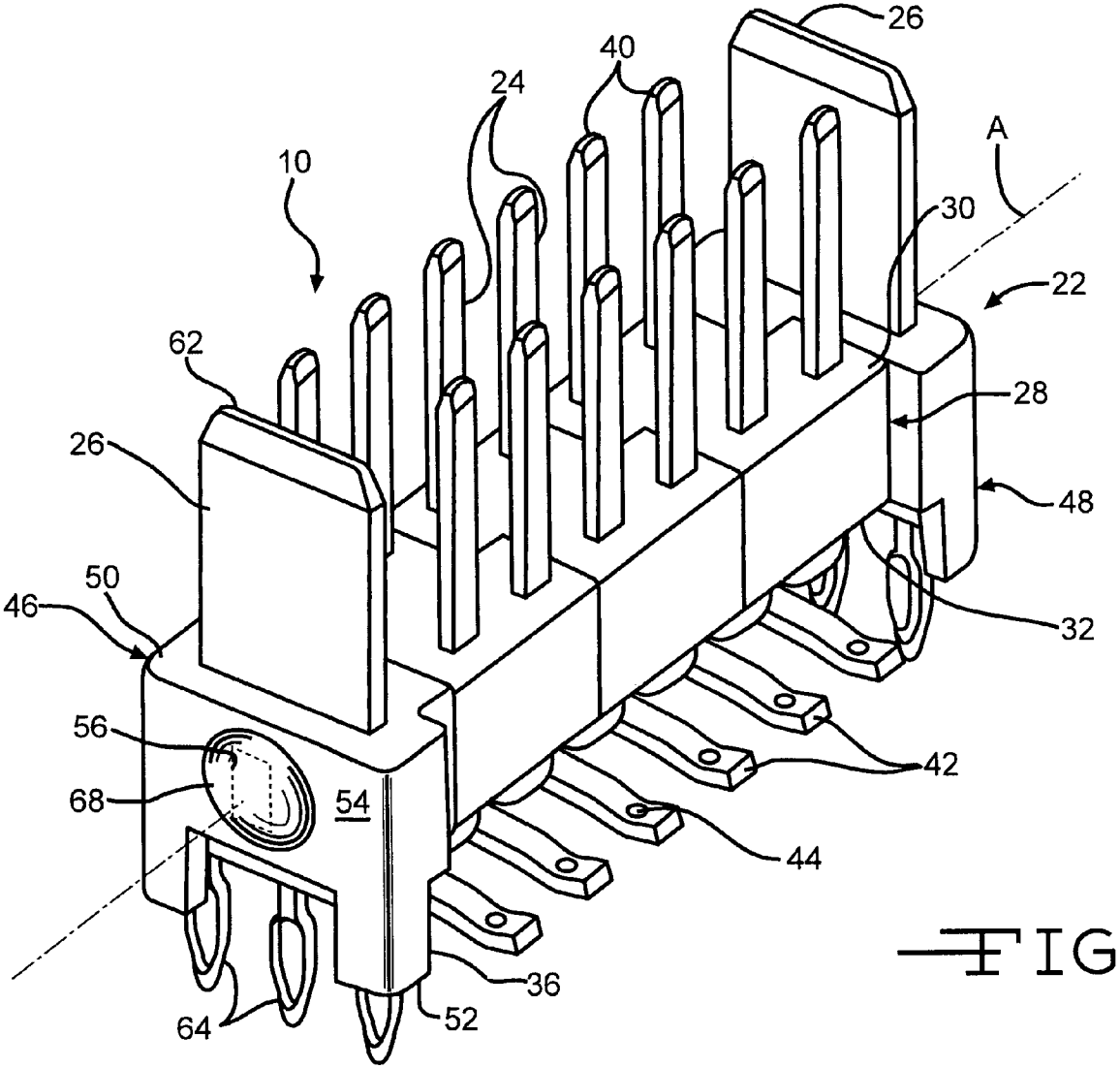
FIG. 1 is a perspective view of a first embodiment of a modular electrical connector.
Figure 2A:
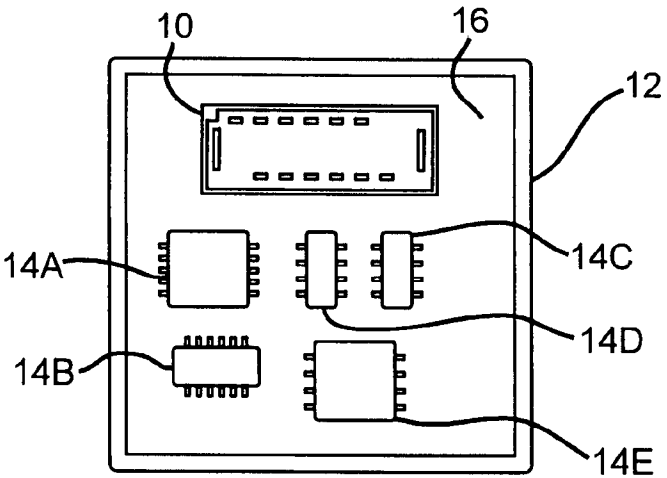
FIG. 2A is a top plan view of a power distribution box for a vehicle that includes the modular electrical connector illustrated in FIG. 1
Figure 2B:
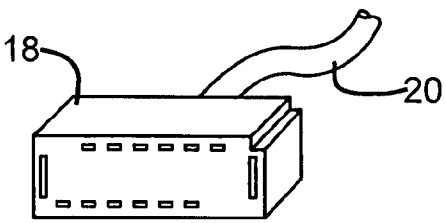
FIG. 2B is a perspective view of an in-line connector structured and configured to mate with the modular electrical connector illustrated in FIG. 1.

Referring now to the drawings, there is illustrated in FIG. 1 a first embodiment of a surface mount technology (SMT) modular electrical connector, indicated generally at 10. The illustrated connector 10 is a header connector that can be used in an electrical box such as may be used in a vehicle, such as the box 12 shown in FIG. 2A. The electrical box 12 may, for example, be a power distribution box, a junction box, and the like. As shown in FIG. 2A, the electrical box 12 includes a plurality of electronic components 14A, 14B, 14C, 14D, and 14E, which are attached to a PCB 16. If, for example, the electrical box 12 is a power distribution box in a vehicle, an in-line connector 18, as shown in FIG. 2B, may be used to connect the SMT connector 10 to various systems within the vehicle via a wiring harness 20.

Figure 4:
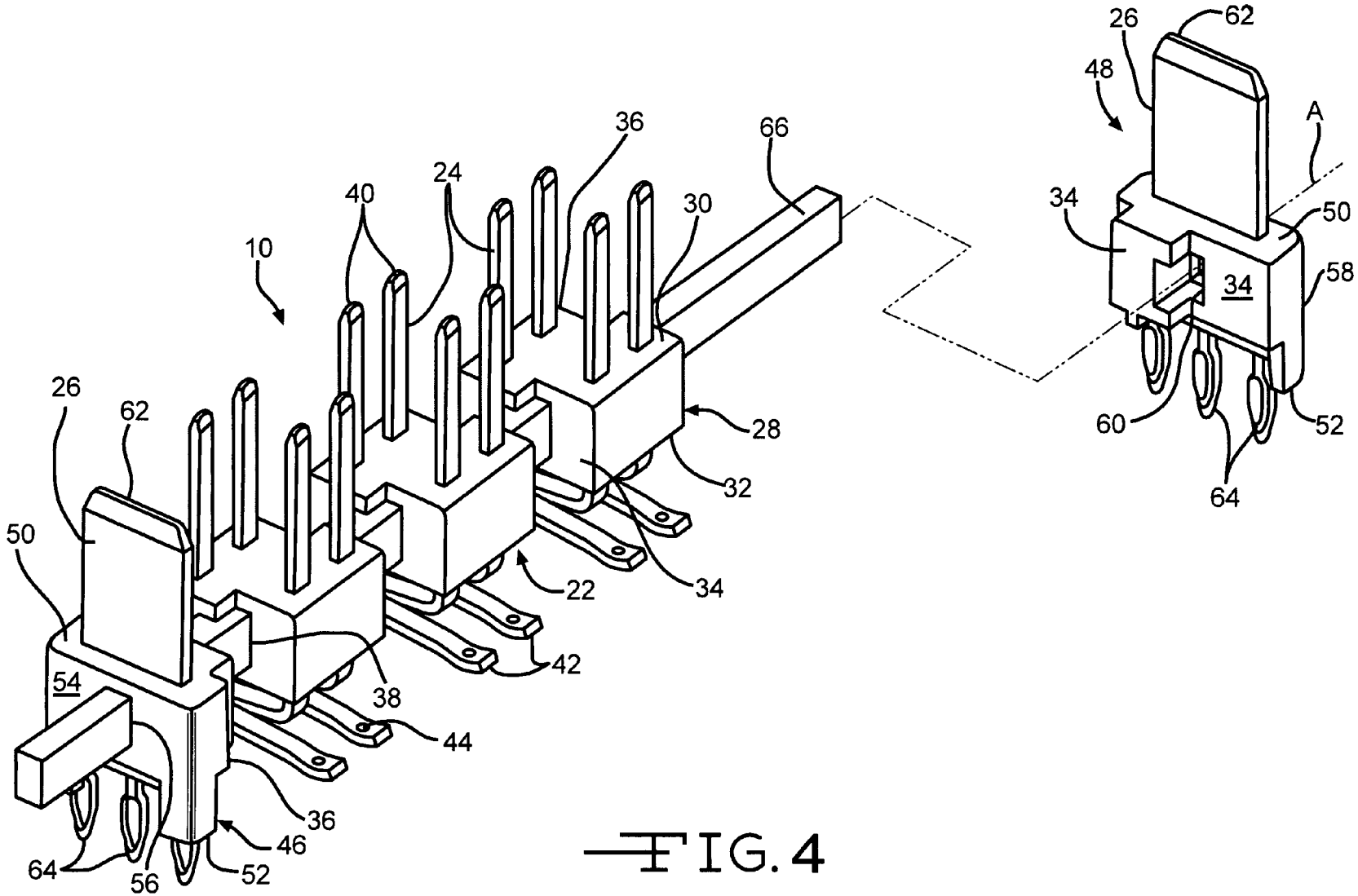
FIG. 4 is an exploded view of the modular electrical connector illustrated in FIG. 1.

Referring to FIGS. 1 and 4, the connector 10 includes a body 22 and a plurality of electrical terminals 24 and 26. The body 22 includes one or more identical body portions 28 having an axis A, an upper or first surface 30, a lower or second surface 32, a first mating surface 34, and second mating surface 36. An axially extending mounting aperture 38 is formed between the mating surface 34 and the mating surface 36.

Figure 3:
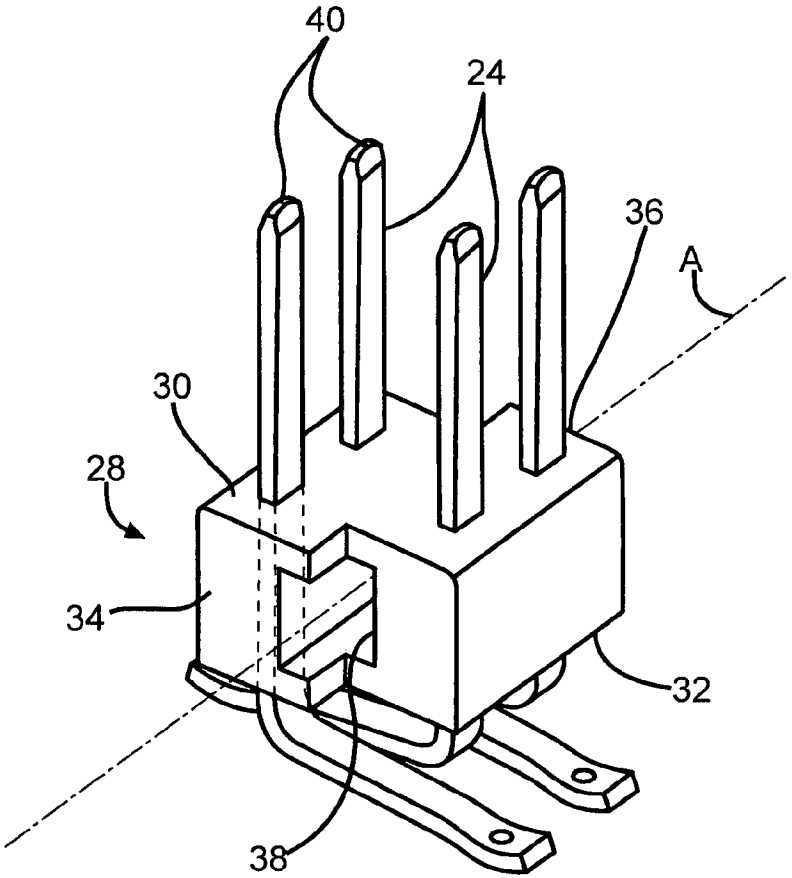
FIG. 3 is an enlarged perspective view of a body portion illustrated in FIG. 1.

As best shown in FIG. 3, four terminals 24 are integrally formed with the body portion 28. Each terminal 24 is substantially L-shaped and has a blade end 40 (extending upwardly from the body portion 28 when viewing FIG. 3) and an SMT end 42 (extending downwardly from the body portion 28 when viewing FIG. 3) having a solder aperture 44.

The SMT end 42 of the terminals 24 may be connected to a PCB 16 by any SMT connection methods that are familiar to those skilled in the art; such as for example the method described in U.S. patent application Ser. No. 11/624,409, the method of connecting an SMT terminal end disclosed therein is incorporated herein by reference.

The body portion 28 may be formed from plastic, such as for example, polyamide (PA), polyphthalamide (PPA), or other desired thermoplastic material. The body 22 may be formed of thermally conductive material, such as ceramic, and polymer filed with heat conductive fibers and/or fillers to create equalization block, enhance heat transfer between terminal blade ends 40, and improve PCB heat dissipation performance. It will be understood that some body portions, such as the body portions 28, may be made of high temperature capable polymers, and other body portions may be made of relatively lower performance or relatively lower temperature capable polymers.

In the illustrated embodiment, the blade ends 40 are 2.8 mm blade terminals. Alternatively, the blade ends 40 may be any other desired type of terminal, such as 0.64 mm, 1.2 mm, 1.5 mm, 4.8 mm, and 6.3 mm blade terminals.

The body 22 also includes a first end portion 46 and a second end portion 48. The first end portion 46 has an axis A, an upper or first surface 50, a lower or second surface 52, an end surface 54, and the second mating surface 36. An axially extending mounting aperture 56 is formed between the end surface 54 and the mating surface 36. The second end portion 48 is substantially similar to the end portion 46 and has an axis A, an upper or first surface 50, a lower or second surface 52, an end surface 58, and the first mating surface 34. An axially extending mounting aperture 60 is formed between the end surface 58 and the mating surface 34.

In the illustrated embodiment, the terminal 26 is integrally formed with the end portions 46 and 48. Each terminal 26 has a blade end 62 (extending upwardly from the end portion 46, b when viewing FIG. 2) and an eye-of-the-needle terminal end 64 (extending downwardly from the end portion 46, 48 when viewing FIG. 2). Such eye-of-the-needle terminal ends 64 attach the connector body 22 to the PCB 16 and ensure that the body 22 remains attached to the PCB 16 during the soldering of the SMT ends 42 of the terminal 24.

Alternatively, the terminals 24 and 26 may be "stitched in" to the body portions 28 and the end portions 46 and 48, respectively, in an automated manufacturing operation that is familiar to those skilled in the art.

The end portions 46 and 48 may be formed from plastic, such as for example; polyamide (PA), polyphthalamide (PPA), or other desired thermoplastic material. The end portions 46, 48 may be formed of thermally conductive material, such as ceramic, and polymer filled with conductive fibers and/or fillers to create equalization block, enhance heat transfer between terminal blade ends 40, and improve PCB heat dissipation performance. It will be understood that some end portions, such as the end portions 46, 48 may be made of high temperature capable polymers, and other body portions may be made of relatively lower performance or relatively lower temperature capable polymers. In the illustrated embodiment, the blade end 62 is a 6.3 mm blade terminal. Alternatively, the blade end 62 may be any other desired type and size of terminal, such as 9.5 mm blade terminal.

As best shown in FIGS. 1 and 4, the connector 10 may be described as modular, that is the connector 10 may be formed by assembling (i.e., interconnecting) any desired number of body portions 28 to first and second end portions 46 and 48, respectively. A connecting rod 66 may then be inserted through the mounting apertures 38, 56, 60, such that a portion of the rod 66 extends outwardly beyond the end surfaces 54 and 58. The ends of the rod 66 may then be deformed, as shown at 68 in FIG. 1, by any desired method, such as by heat staking or by sonic welding. The illustrated rod 66 has a rectangular cross section to prevent rotation and/or axial bending of the assembled components prior to heat staking or sonic welding. Alternatively, the rod 66 may have any other desired cross sectional shape, such as square, triangular, other geometric shapes, and oval and irregular shapes.

In the illustrated embodiment, the mating surfaces 34 and 36 are stepped. It will be understood however, that the mating surfaces 34 and 36 may have any desired shape which facilitates the interconnection of the mating surfaces 34 and 36.

In the embodiment illustrated in FIG. 1, the connector 10 includes three body portions 28. It will be understood however, that the connector 10 may be formed with any desired number of body portions, such as one body portion 28, two body portions 28, or four or more body portions 28.

The small size of the body portion 28 and end portions 46, 48 relative to known SMT connector strips minimizes the effect of material shrinkage and warping that can occur when molding or forming larger connector strips or components. Accordingly, lower cost polymers may be used. Additionally, the final assembly process of the connector 10 allows for adjustment and alignment of the component body portions 28 and end portions 46, 48, such that required tolerances may be easily achieved.

By standardizing the size and geometry of the internal (i.e., the terminals 24) and external (i.e., the body portions 28) components, a common mold tool may be used, reducing cost. Additionally, automated assembly equipment may be used for final connector 10 assembly.

The connector 10 described herein above is modular and scaleable to allow the manufacture of multiple different PCB header connectors, such as the connector 10, using different combinations of the body portions 28, end portions 46, 48, and rods 66, and processes, such as heat staking or sonic welding.

It will be understood that the body portions 28 and end portions 46 and 48 may have any desired number and combination of electrical terminals, such as the terminals 24 and 26. For example, one body portion 28 may have a first combination of electrical terminals 24, an adjacent body portion 28 may have a second combination of electrical terminals 24, and the end portions 46 and 48 may have a third combination of electrical terminals 26, advantageously allowing for modularity and scaleability to allow the manufacture of multiple different PCB header connectors.

Reduced overall complexity of the component parts of the connector 10 allows for efficient use of manufacturing equipment. For example, one family mold; i.e., a single molding tool with multiple cavities for all assembly components, may be used to form the body portions 28, end portions 46, 48, and rods 66. A single assembly machine may be used to stitch terminals 24 into the body portions 28, end portions 46, 48 (if the terminals 24 are not integrally molded therewith).

Figures 5, 6:
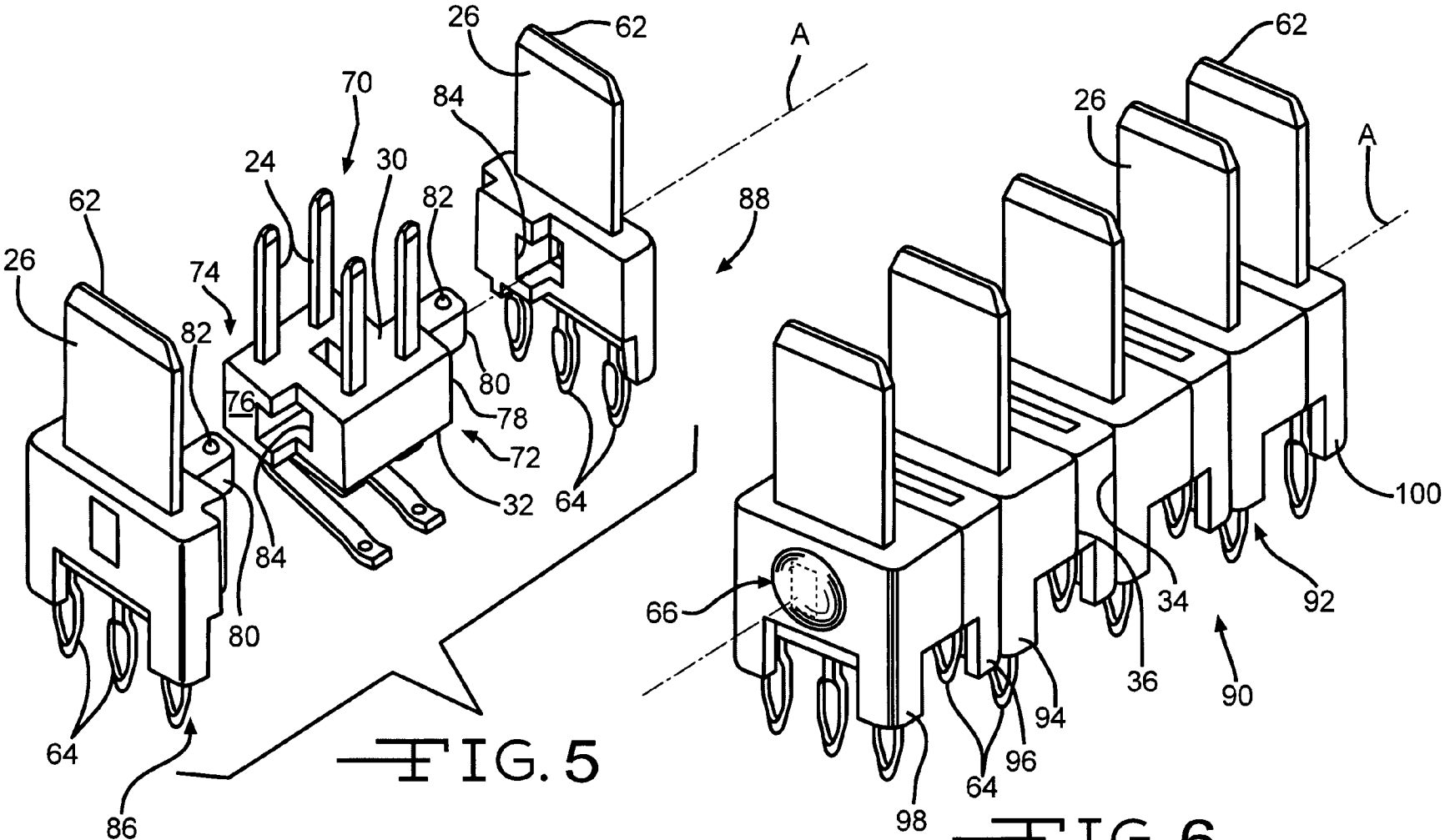
FIG. 5 is an exploded perspective view of a second embodiment of the modular electrical connector.
FIG. 6 is a perspective view of a third embodiment of the modular electrical connector.

Referring now to FIG. 5, there is illustrated a second embodiment of an SMT electrical connector, indicated generally at 70. The connector 70 is substantially identical to the connector 10, except for the method of interconnecting the body portions.

The illustrated connector 70 includes a body 72 and a plurality of the electrical terminals 24 and 26. The body 72 includes one or more identical body portions 74 having an axis A, the upper or first surface 30, the lower or second surface 32, a first mating surface 76, and second mating surface 78. For the sake of brevity and clarity, the connector 70 is shown having only one body portion 74, however, any desired number of body portions 74 my be used.

In the illustrated embodiment, the mating surfaces 76 and 78 are stepped. The second mating surface 78 includes an outwardly and axially extending male connector portion 80. The connector portion 80 includes a boss 82 extending outwardly (upwardly as viewed in FIG. 5) of the first surface 30. In the illustrated embodiment, the boss 82 is semi-spherical; however the boss 82 may be any other desired shape. The first mating surface 76 includes a connecting aperture 84 corresponding in size and shape to the size and shape of the connector portion 80.

It will be understood however, that the mating surfaces 76 and 78, and the connector portion 80 and the aperture 84, may have any desired shape which facilitates the interconnection of the mating surfaces 76 and 78.

In the illustrated embodiment, the four terminals 24 are integrally formed with the body portions 74, as described herein above regarding the connector 10. The body portion 74 may be formed from plastic, such as described herein above regarding the body portion 28.

The body 72 also includes a first end portion 86 and a second end portion 88. The first end portion 86 has an axis A, the upper or first surface 30, the lower or second surface 32, the end surface 54, and the second mating surface 78. The second end portion 88 is substantially similar to the end portion 86 and has an axis A, the upper or first surface 30, the lower or second surface 32, the end surface 58, and a first mating surface 76.

In the illustrated embodiment, the terminal 26 is integrally formed with the end portions 86 and 88. The end portions 86 and 88 may be formed from plastic, such as described herein above regarding the end portions 46 and 48.

As best shown in FIG. 5, the connector 70 may be formed by assembling (i.e., interconnecting) any desired number of body portions 74 to first and second end portions 86 and 88, respectively, in a snap-fit connection.

In the embodiment illustrated in FIG. 5, the connector 70 includes one body portion 74. It will be understood however, that the connector 70 may be formed with any desired number of body portions, such as two or more body portions 74.

Referring now to FIG. 6, there is illustrated a third embodiment of an SMT electrical connector, indicated generally at 90. The illustrated connector 90 includes a body 92 having a plurality of body portions 94, and a spacer portion 96 between each body portion 94. The illustrated embodiment of the connector 90 includes first and second end portions 98 and 100, respectively. The body portions 94, end portions 98, 100, and spacer portions 96 may be connected by a connecting rod 66, as described herein above. The body portion 94 includes the terminal 26 having the blade end 62 and the terminal end 64 as described regarding the connectors 10 and 70.

The body portion 94 and the spacer portion 96 may include the mating surfaces 34 and 36 as described in detail regarding the connector 10. Alternatively, the body portion 94 and the spacer portion 96 may include the snap-fit mating surfaces 76 and 78 as described in detail regarding the connector 70. The use of the spacer portions 96 allows the pitch spacing between the terminals 26 to be easily changed.

The principle and mode of operation of the electrical connector have been described in its various embodiments. However, it should be noted that the electrical connector described herein may be practiced otherwise than as specifically illustrated and described without departing from its scope.

What is claimed is:

1. A modular electrical connector comprising:

a first connector portion having an electrical terminal and a mating surface;

a second connector portion having a mating surface, the mating surface of the second connector portion being interconnected to the mating surface of the first connector portion, the first connector portion and the second connector portion defining a connector body having a first end and a second end; and wherein a first end of the connecting rod bears against an outer surface of the first connector portion, and a second end of the connecting rod bears against an outer surface of the second connector portion a connecting rod;

wherein each of the first and second connector portions have an axially formed aperture;

wherein the connecting rod extends through the axially formed apertures of the first and second connector portions; and wherein a first portion of the connecting rod is deformed against an outer surface of the first end of the connector body and a second portion of the connecting rod is deformed against an outer surface of the second end of the connector body, the first and second portions of the connecting rod fastening the first and second connector portions together.

2. The modular electrical connector according to claim 1, wherein the second connector portion further includes an electrical terminal.

3. The modular electrical connector according to claim 1, wherein the first connector portion includes two mating surfaces and the second connector portion is interconnected to a first of the two mating surfaces of the first connector portion, the electrical connector further including a third connector portion having a mating surface, the mating surface of the third connector portion being interconnected to a second of the two mating surfaces of the first connector portion, the first, second, and third connector portions defining the connector body.

4. The modular electrical connector according to claim 3, wherein the third connector portion further includes an electrical terminal.

5. The modular electrical connector according to claim 1, wherein the first connector portion and the second connector portion are fastened together in a snap-fit.

6. The modular electrical connector according to claim 3, wherein the first, second, and third connector portions have a plurality of combinations of electrical terminals.

7. A modular electrical connector comprising:

a first connector portion having an electrical terminal;

a second connector portion; and a connecting rod extending through the first and second connector portions, a first end of the connecting rod bearing against an outer surface of the first connector portion, and a second end of the connecting rod bearing against an outer surface of the second connector portion, the first and second ends of the connecting rod urging the first and second connector portions together and fastening the first and second connector portions together.

8. The modular electrical connector of claim 7, wherein the electrical terminal extends in a first direction and the connecting rod extends in a second direction that is perpendicular to the first direction.

9. The modular electrical connector of claim 7, wherein the first connector portion has a mating surface, the second connector portion has a mating surface, and the mating surface is interconnected to the mating surface of the first connector portion.

10. The modular electrical connector of claim 9, wherein the electrical terminal extends in a first direction and the connecting rod extends in a second direction that is perpendicular to the first direction.

11. The modular electrical connector of claim 10, wherein the connecting rod is non-conductive.

12. The modular electrical connector of claim 7, wherein the first connector portion and the second connector portion define a connector body having a first end and a second end, and wherein the first end of the connecting rod bears against the first end of the connector body and the second end of the connecting rod bears against the second end of the connector body.

13. A modular electrical connector comprising:

a first connector portion having an electrical terminal;

a second connector portion; and a connecting rod extending through the first and second connector portions and fastening the first body portion and the second body portion together.

14. The modular electrical connector of claim 13, wherein the electrical terminal extends in a first direction and the connecting rod extends in a second direction that is perpendicular to the first direction.

* * * * *

UNITED STATES PATENT AND TRADEMARK OFFICE

CERTIFICATE OF CORRECTION

PATENT NO. : 7,713,096 B2
APPLICATION NO. : 12/006973
DATED : May 11, 2010
INVENTOR(S) : Slobodan Pavlovic et al.

It is certified that error appears in the above-identified patent and that said Letters Patent is hereby corrected as shown below:

Claim 1, Column 5, Lines 63 through 66, please delete said Lines 63 through 66 from this claim.

Claim 13, Column 7, Line 6, delete the "." and insert a --;--.

Claim 13, Column 7, Line 7, insert: --wherein a first end of the connecting rod bears against an outer surface of the first connector portion, and a second end of the connecting rod bears against an outer surface of the second connector portion.--.

Signed and Sealed this

Twenty-second Day of June, 2010

David J. Kappos

David J. Kappos
*Director of the United States Patent and Trademark Office*